US010072659B2

(12) United States Patent
Sun

(10) Patent No.: US 10,072,659 B2
(45) Date of Patent: Sep. 11, 2018

(54) PRESSURE CONTROL VALVE AND SCROLL COMPRESSOR

(71) Applicant: EMERSON CLIMATE TECHNOLOGIES (SUZHOU) CO., LTD., Jiangsu (CN)

(72) Inventor: Qingfeng Sun, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 304 days.

(21) Appl. No.: 14/413,971

(22) PCT Filed: Jul. 5, 2013

(86) PCT No.: PCT/CN2013/078893

§ 371 (c)(1),
(2) Date: Jan. 9, 2015

(87) PCT Pub. No.: WO2014/008835

PCT Pub. Date: Jan. 16, 2014

(65) Prior Publication Data

US 2015/0176585 A1 Jun. 25, 2015

(30) Foreign Application Priority Data

Jul. 10, 2012 (CN) ..... 2012 1 0237038
Jul. 10, 2012 (CN) ..... 2012 2 0331234 U
(Continued)

(51) Int. Cl.
*F01C 1/02* (2006.01)
*F01C 1/063* (2006.01)
(Continued)

(52) U.S. Cl.
CPC ..... *F04C 28/24* (2013.01); *F04C 18/0215* (2013.01); *F04C 29/128* (2013.01); *F04C 23/008* (2013.01); *Y10T 137/7771* (2015.04)

(58) Field of Classification Search
CPC ..... F04C 28/128
(Continued)

(56) References Cited

U.S. PATENT DOCUMENTS 919,036 A * 4/1909 Langer ..... F04B 39/1073 137/512.1
3,811,466 A * 5/1974 Ohringer ..... F16K 15/147 137/493
(Continued)

FOREIGN PATENT DOCUMENTS

CN 2233016 Y 8/1996
CN 1611787 A 5/2005
(Continued)

OTHER PUBLICATIONS

First Chinese Office Action regarding Application No. 201210410053.1 dated May 5, 2015. English translation provided by http://globaldossier.uspto.gov.
(Continued)

*Primary Examiner* — Deming Wan
(74) *Attorney, Agent, or Firm* — Harness, Dickey & Pierce, P.L.C.

(57) ABSTRACT

A pressure control valve (100, 200) comprises a valve seat (140, 160) in which is formed a valve hole (142, 162), a first valve sheet member (110, 210) which covers the valve hole and is provided with a fluid passage (118, 218) thereon, and a second valve sheet member (120, 220) which is provided between the valve seat and the first valve sheet member and covers the fluid passage. Wherein, given that the direction directed from the second valve sheet member to the first valve sheet member is a first direction, when the pressure difference across two sides of the first valve sheet member and the second valve sheet member is directed to the first direction and is greater than or equal to a first preset value, the first valve sheet member is opened; when the pressure
(Continued)

difference is directed to a second direction opposite to the first direction and is greater than or equal to a second preset value, the second valve sheet member is opened. Also disclosed is a scroll compressor comprising the pressure control valve. Also disclosed is a scroll compressor comprising a throttle valve for preventing or weakening the return flow from the back-pressure chamber to the pressure chamber.

14 Claims, 13 Drawing Sheets

(30) Foreign Application Priority Data

Oct. 24, 2012 (CN) ..... 2012 1 0410053
Oct. 24, 2012 (CN) ..... 2012 2 0547200 U

(51) Int. Cl.

| | |
|---|---|
| ***F03C 2/08*** | (2006.01) |
| ***F04C 2/02*** | (2006.01) |
| ***F04C 2/063*** | (2006.01) |
| ***F04C 18/02*** | (2006.01) |
| ***F04C 29/12*** | (2006.01) |
| ***F16K 15/16*** | (2006.01) |
| ***F04C 28/24*** | (2006.01) |
| *F04C 23/00* | (2006.01) |

(58) Field of Classification Search
USPC ..... 137/856, 855, 493, 493.1; 418/63, 55.1, 418/57, 270
See application file for complete search history.

(56) References Cited

U.S. PATENT DOCUMENTS

| | | | | |
|---|---|---|---|---|
| 4,714,416 | A * | 12/1987 | Sano | F04B 39/1073 137/856 |
| 6,223,956 | B1 * | 5/2001 | Albers | B65D 47/2031 137/493 |
| 6,296,014 | B1 * | 10/2001 | Miura | B60K 15/04 137/540 |
| 8,763,633 | B2 * | 7/2014 | Buckland | F16K 15/141 137/493 |
| 2002/0119059 | A1 * | 8/2002 | Sato | F04B 39/1073 417/571 |

FOREIGN PATENT DOCUMENTS

| | | | |
|---|---|---|---|
| CN | 1670372 | A | 9/2005 |
| CN | 1896524 | A | 1/2007 |
| CN | 1971050 | A | 5/2007 |
| CN | 100993100 | Y | 12/2007 |
| CN | 201943953 | U | 8/2011 |
| CN | 202926632 | U | 5/2013 |
| EP | 0174530 | A2 | 3/1986 |
| JP | 2002349458 | A | 12/2002 |
| JP | 2003155983 | A | 5/2003 |
| JP | 4257639 | B2 | 4/2009 |
| JP | 4680863 | B2 | 5/2011 |

OTHER PUBLICATIONS

International Search Report for PCT/CN2013/078893 (in English and Chinese), dated Oct. 17, 2013; ISA/CN.

* cited by examiner

PRESSURE CONTROL VALVE AND SCROLL COMPRESSOR

CROSS-REFERENCE OF THE RELATED APPLICATION

This application is the national phase of International Application No. PCT/CN2013/078893, titled "PRESSURE CONTROL VALVE AND SCROLL COMPRESSOR", filed on Jul. 5, 2013, which claims priorities to Chinese patent application No. 201210237038.1 titled "PRESSURE CONTROL VALVE AND SCROLL COMPRESSOR INCLUDING SAME" and filed with the Chinese State Intellectual Property Office on Jul. 10, 2012; Chinese patent application No. 201220331234.0 titled "PRESSURE CONTROL VALVE AND SCROLL COMPRESSOR INCLUDING SAME" and filed with the Chinese State Intellectual Property Office on Jul. 10, 2012; Chinese patent application No. 201210410053.1 titled "PRESSURE CONTROL VALVE AND SCROLL COMPRESSOR" and filed with the Chinese State Intellectual Property Office on Oct. 24, 2012; and Chinese patent application No. 201220547200.5 titled "PRESSURE CONTROL VALVE AND SCROLL COMPRESSOR" and filed with the Chinese State Intellectual Property Office on Oct. 24, 2012, which are incorporated herein by reference in their entireties.

TECHNICAL FIELD

The present application relates to a pressure control valve and a scroll compressor.

BACKGROUND

This section only provides background information relate to the disclosure, and may not necessarily constitute the prior art.

A conventional check valve includes a valve seat in which a valve hole is formed and a valve disc for opening or closing the valve hole. When a pressure difference across the valve disc is greater than a predetermined value and is directed to open the valve disc in a first direction, the valve disc is opened to allow fluid to flow through the check valve. When the pressure difference across the valve disc is direct towards a second direction opposite to the first direction, the valve disc will never be opened no matter what the value of the pressure difference across the valve disc is, so as to prevent the fluid from flowing in the opposite direction. Such check valve entails a function of allowing fluid to flow in a single direction.

However, in some cases, the check valve is required to be opened not only when the pressure difference in the first direction reaches a first predetermined value, but also when the pressure difference in the second direction reaches a second predetermined value, so as to, for example, achieve pressure relief.

Conventionally, the person skilled in the art uses a solenoid valve and pressure sensors arranged downstream and upstream of the solenoid valve to achieve the above function. However, such arrangement is relatively complex and is expensive.

In view of this, there is a need for a configuration of a valve capable of providing a function of bi-direction flowing of fluid according to a pressure difference across the valve.

SUMMARY

An object according to one or more embodiments of the disclosure is to provide a pressure control valve capable of providing a function of bi-direction flow of liquid according to a pressure difference across the valve.

A further object according to one or more embodiments of the disclosure is to provide a pressure control valve with a simple structure and a low cost.

A still further object according to one or more embodiments of the disclosure is to provide a scroll compressor with the optimized operating performance.

In order to achieve one or more objects described above, according to an aspect of the disclosure, a pressure control valve is provided, including: a valve seat in which a valve hole is formed; a first valve disc member which is configured to shield the valve hole and on which a fluid passage is formed; and a second valve disc member which is arranged between the valve seat and the first valve disc member and is configured to shield the fluid passage. Assuming that a direction directed from the second valve disc member to the first valve disc member is a first direction, when a pressure difference across the first valve disc member and the second valve disc member is directed to the first direction and is greater than or equal to a first predetermined value, the first valve disc member is opened to allow fluid to flow through the pressure control valve; and when the pressure difference across the first valve disc member and the second valve disc member is directed to a second direction opposite to the first direction and is greater than or equal to a second predetermined value, the second valve disc member is opened to allow fluid to flow through the pressure control valve.

According to a further aspect of the disclosure, a scroll compressor including the above pressure control valve is provided. Specifically, the scroll compressor may include: a movable scroll component including a first end plate and a movable scroll vane formed on the first end plate; a fixed scroll component including a second end plate and a fixed scroll vane formed on the second end plate, wherein the fixed scroll vane is engaged with the movable scroll vane in such a way that a series of compression pockets are formed between the fixed scroll vane and the movable scroll vane, and a recess is formed on a side of the second end plate opposite to a side of the second end plate on which the fixed scroll vane is formed; and a sealing assembly arranged in the recess, wherein a space between the recess and the sealing assembly forms a backpressure cavity, and the backpressure cavity is in fluid communication with one of the compression pockets via a communicating passage, and wherein the pressure control valve is arranged in the communicating passage.

According to a still further aspect of the disclosure, a scroll compressor is provided, including: a movable scroll component including a first end plate and a movable scroll vane formed on the first end plate; a fixed scroll component including a second end plate and a fixed scroll vane formed on the second end plate, wherein the fixed scroll vane is engaged with the movable scroll vane in such a way that a series of compression pockets are formed between the fixed scroll vane and the movable scroll vane, and a recess is formed on a side of the second end plate opposite to a side of the second end plate on which the fixed scroll vane is formed; and a sealing assembly arranged in the recess, wherein a space between the recess and the sealing assembly forms a backpressure cavity, and the backpressure cavity is in fluid communication with one of the compression pockets via a communicating passage, and wherein a throttle valve for preventing or decreasing a flow of fluid from the backpressure cavity back to the compression pocket is arranged in the communicating passage.

The pressure control valve and/or scroll compressor according to one or more embodiments of the disclosure have/has the following advantages:

In a pressure control valve according to an embodiment of the disclosure, a first valve disc member configured to shield or close a valve hole in a valve seat and a second valve disc member configured to shield or close a fluid passage in the first valve disc member are provided. When a pressure difference across the first valve disc member and the second valve disc member is directed to a first direction and is greater than or equal to a first predetermined value, the first valve disc member can be opened, and when the pressure difference across the first valve disc member and the second valve disc member is directed to a second direction and is greater than or equal to a second predetermined value, the second valve disc member can be opened. Therefore, the pressure control valve according to the present embodiment is capable of allowing fluid to flow in two directions according to the pressure difference. Furthermore, compared to a solution in which a solenoid valve and a pressure sensor are used, the pressure control valve according to the present embodiment has a simple structure and a significantly reduced cost.

In a pressure control valve according to another embodiment of the disclosure, the first predetermined value and the second predetermined value can be set to be the same or be different from each other. Hence, the pressure control valve according to the present embodiment can be easily used in various applications.

In a pressure control valve according to another embodiment of the disclosure, the first predetermined valued can be set, for example, by setting at least one of the elasticity and a pressure receiving area of the first valve disc member. In other words, the first predetermined value can be easily changed or set by changing material characteristics or shape characteristics (for example thickness and width) of the first valve disc member, or by changing the pressure receiving area of the first valve disc member or by changing the both. Similarly, the second predetermined value can be set by setting at least one of the elasticity of the second valve disc member and the area of the fluid passage. Hence, the pressure control valve according to the present embodiment can be conveniently adapted to various applications by changing the characteristics of the first valve disc member and/or the second valve disc member.

In a pressure control valve according to another embodiment of the disclosure, the first valve disc member and the second valve disc member can each be a stamped member punched out from a metal sheet or a moulded member moulded from elastic material. Hence, the first valve disc member and the second valve disc member can be easily manufactured at a low cost.

In a pressure control valve according to another embodiment of the disclosure, the first valve disc member can be integrally formed with the second valve disc member. For example, the first valve disc member and the second valve disc member can be directly formed into one piece by moulding process. Alternatively, the first valve disc member and the second valve disc member can be separately formed and then are joined together by any proper connecting means (for example welding, sticking, riveting or the like). In the pressure control valve with such configuration, the number of the components is further reduced, and the configuration of the valve is simplified.

A pressure control valve according to another embodiment of the disclosure may further include a valve guard member for limiting the displacement of the first valve disc member in the first direction. Hence, the risk of excessive deformation and/or fatigue fracture of the first valve disc member can be reduced, and the reliability of the pressure control valve can be improved.

In a pressure control valve according to another embodiment of the disclosure, the valve guard member, the first valve disc member and the second valve disc member can be fixed on the valve seat by fastener(s), so as to form a complete assembly. It is advantageous to mount such assembly in an application such as a compressor.

In a pressure control valve according to another embodiment of the disclosure, the first predetermined value can be set by setting at least one of the elasticity of the first elastic member configured for biasing the first valve disc member and the pressure receiving area of the first valve disc member. Additionally, the second predetermined value can be set by setting at least one of the elasticity of the second elastic member configured for biasing the second valve disc member and the area of the fluid passage. In the pressure control valve according to the present embodiment, the first predetermined value and the second predetermined value can be accurately set or changed by accurately setting the elasticity of the first elastic member and the second elastic member, thereby improving the accuracy of the pressure control valve in response to the pressure difference.

In a pressure control valve according to another embodiment of the disclosure, the first valve disc member, the second valve disc member, the first elastic member and the second elastic member can be retained in the valve seat by a retaining ring so as to form a complete assembly. It is advantageous to mount such assembly in an application such as a compressor.

In a scroll compressor according to another embodiment of the disclosure, the pressure control valve according to any one of the embodiments described above is arranged in a communicating passage communicating the backpressure cavity with one of the compression pockets (such as the medium pressure pocket). Hence, when the compressor operates, for example, in a heavier-load working condition, the pressure in the medium pressure pocket is greater than that in the backpressure cavity so as to form a pressure difference in a first direction. In this case, the fluid in the medium pressure pocket can flow into the backpressure cavity for applying an appropriate backpressure to the scroll assembly. Additionally, due to the presence of the pressure control valve, when the pressure difference between the backpressure cavity and the medium pressure pocket is lower than a specific value, no fluid flows between the backpressure cavity and the medium pressure pocket, thereby reducing the pressure fluctuation in the backpressure cavity. When the compressor is turned, for example, back to the lighter-load working condition from the heavier-load working condition, the pressure in the backpressure cavity is greater than that in the medium pressure pocket so as to form a pressure difference in a second direction. When the pressure difference reaches a certain value, the fluid in the backpressure cavity can flow into the medium pressure pocket to achieve the pressure relief in the backpressure cavity. In this case, the pressure with a lower value can be maintained in the backpressure cavity, so that the contacting pressure between two scroll components can be reduced and the wear of the scroll assembly and other relevant components can be reduced. In other words, the scroll compressor according to the present embodiment not only can reduce the pressure fluctuation in the backpressure cavity, but also can provide a variable backpressure according to the working condition in which the compressor operates, thereby optimizing the operating performance of the compressor.

In a scroll compressor according to another embodiment of the disclosure, a part of the fixed scroll component around the communicating passage can be used as a valve seat of the pressure control valve, and the communicating passage can be used as a valve hole of the pressure control valve. In other words, the valve seat of the pressure control valve can be formed by a part of the fixed scroll component, thus further simplifying the structure of the compressor.

In a scroll compressor according to another embodiment of the disclosure, the whole assembly or valve seat of the pressure control valve can be fitted in the communicating passage, thus further simplifying the assembling process of the compressor.

In a scroll compressor according to another embodiment of the disclosure, a throttle valve for preventing or reducing a flow of fluid from the backpressure cavity back to the compression pocket is arranged in a communicating passage communicating the backpressure cavity with one of the compression pockets (for example, the medium pressure pocket). In the scroll compressor according to the present embodiment, it can be ensured that there is a sufficient backpressure in the backpressure cavity, even if the compressor operates in a hash working condition, thus improving the operating performance of the compressor. Additionally, when the compressor alternately operates in different working condition, the pressure fluctuation in the backpressure cavity can be reduced, thereby further improving the operating performance of the compressor. Particularly, the throttle valve may be a check valve allowing the fluid to flow from the compression pocket to the backpressure cavity. Hence, the total manufacturing cost of the compressor can be further reduced.

With the description given herein, other application fields will become apparent. It should be understood that the specific examples and embodiments described in this section are for illustrative purposes only and do not intend to limit the scope of the disclosure.

BRIEF DESCRIPTION OF THE DRAWINGS

This section describes the drawings for purposes of illustration only but not intention to limit the scope of the disclosure in any ways.

DETAILED DESCRIPTION

Figure 1:
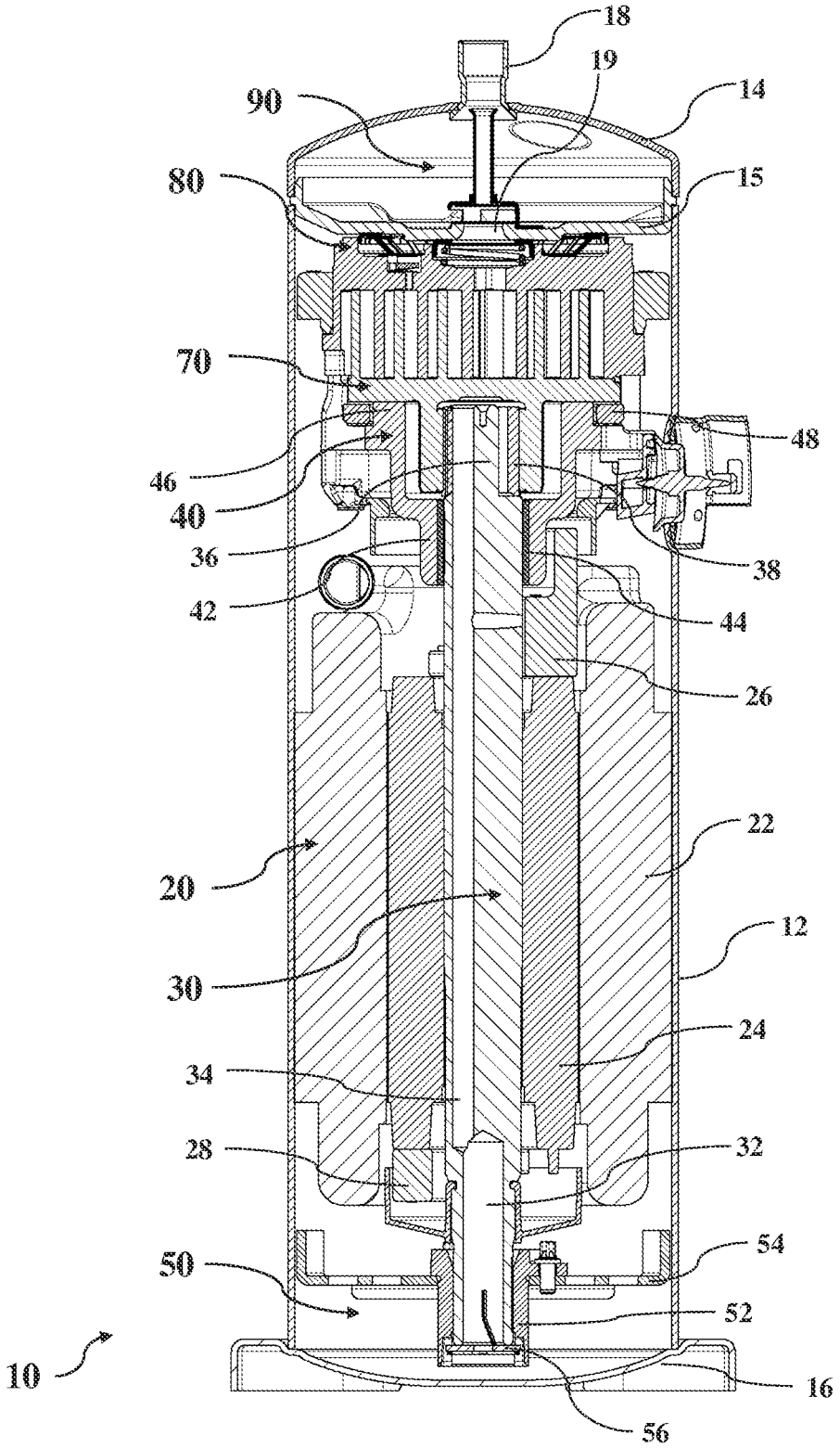
FIG. 1 is a longitudinal sectional view of a scroll compressor according to a first embodiment of the disclosure.

The following description is, in nature, only illustrative and is not intended to limit the disclosure, and application and use thereof. It may be noted that like reference numerals indicate like or similar components or features throughout the drawings.

Hereinafter, the basic configuration and the principle of a scroll compressor 10 according to an embodiment of the disclosure will be descried with reference to FIGS. 1, 2, 3A and 3B.

Figure 2:
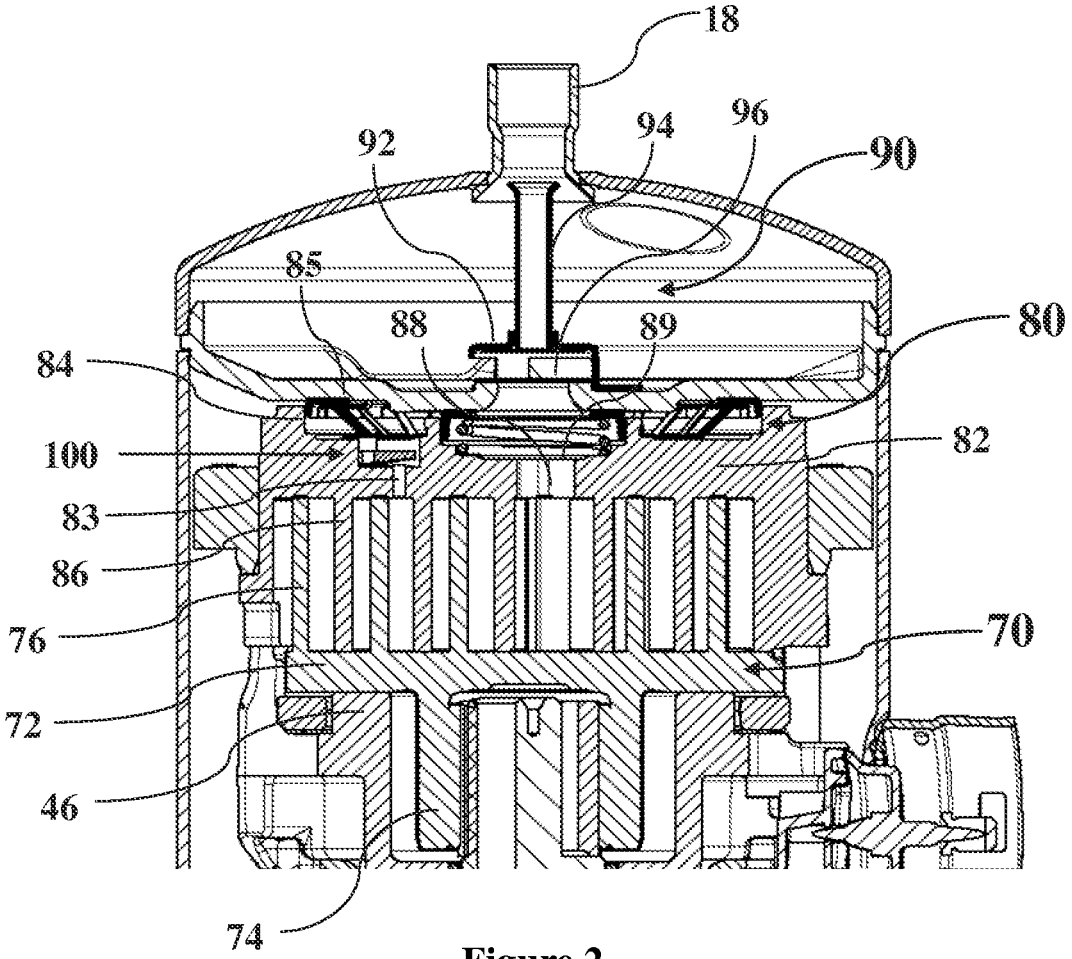
FIG. 2 is a partially enlarged view of FIG. 1.

As illustrated in FIG. 1, the scroll compressor 10 generally includes a substantially cylindrical housing 12, a top cover 14 arranged at one end of the housing 12, a bottom cover 16 arranged at the other end of the housing 12 and a partition plate 15 arranged between the top cover 14 and the housing 12 to partition an inner space of the compressor into a high-pressure side and a low-pressure side. The high-pressure side is formed between the partition plate 15 and the top cover 14, and the low-pressure side is formed among the partition plate 15, the housing 12 and the bottom cover 16. An intake joint (not shown) for suctioning fluid is arranged at the low-pressure side, and an exhaust joint 18 for discharging compressed fluid is arranged at the high-pressure side. The housing 12 is provided therein with an electric machine 20 including a stator 22 and a rotator 24. A driving shaft 30 is arranged in the rotator 24 to drive a compressing mechanism including a fixed scroll component 80 and a movable scroll component 70. Referring to FIG. 2, the movable scroll component 70 includes an end plate 72, a hub portion 74 formed at one side of the end plate, and a spiral vane 76 formed at the other side of the end plate. The fixed scroll component 80 includes an end plate 82, a spiral vane 86 formed at the one side of the end plate, and an exhaust port 88 formed at a substantially central position on the end plate. A series of compression pockets which have volumes gradually reduced from a radially outer side to a radially inner side are formed between the spiral vane 86 of the fixed scroll component 80 and the spiral vane 76 of the movable scroll component 70. The radially outmost compression pocket is at a suction pressure, and the radially innermost compression pocket is at a discharge pressure. The intermediate compression pocket is at a pressure between the suction pressure and the discharge pressure, and is thus referred to as a medium pressure pocket.

The movable scroll component 70 is supported at one side thereof by an upper portion of a main bearing housing 40. Here, the portion of the main bearing housing 40 that supports the movable scroll component 70 is configured to be a thrust member. In another embodiment, the thrust member and the main bearing housing can be separately formed and then fixed together by fastening means. The main bearing housing 40 is fixed relative to the housing 12 by appropriate fastening means.

The driving shaft 30 is rotatably supported by a main bearing 44 arranged in the main bearing housing 40 and a lower bearing 52 arranged in a lower bearing housing 50. The lower bearing housing 50 is fixed relative to the housing 12 or the bottom cover 16 by means of for example a supporter 54. Additionally, a counterweight 26 or a counterweight 28 can be arranged on the driving shaft 30 or the rotator 24 to maintain dynamic balance.

An eccentric crank pin 36 is arranged at one end of the driving shaft 30. An unloading bush 38 is arranged between the eccentric crank pin 36 and the hub portion 74 of the movable scroll component 70. Under drive of the electric machine 20, the movable scroll component 70 can orbit relative to the fixed scroll component 80 (that is, a center axis of the movable scroll component 70 rotates about a center axis of the fixed scroll component 80, while the movable scroll component 70 itself does not rotate about its center axis) so as to achieve compression of fluid. The orbiting motion described above can be achieved by a Oldham coupling 48 arranged between the fixed scroll component 70 and the movable scroll component 80.

The fluid compressed by the fixed scroll component 70 and the movable scroll component 80 is discharged to the high-pressure side via the exhaust port 88. In order to prevent the fluid at the high-pressure side from flowing back to the low-pressure side via the exhaust port 88 in a specific case, a check valve or an exhaust valve 89 is arranged at the exhaust port 88. The exhaust valve 89 allows the fluid in the compression pocket to flow to the high-pressure side, but prevents the fluid at the high-pressure side from flowing back to the compression pocket.

Alternatively or additionally, a shutdown valve 90 can be arranged downstream of the exhaust port 88. In the example shown in FIGS. 1 and 2, the shutdown valve 90 is arranged at an opening 19 of the partition plate 15. The opening 19 is substantially aligned with the exhaust port 88 of the fixed scroll component 80. The shutdown valve 90 can include a base portion 92, an elongated pipeline portion 94 connected to the base portion 92, and a valve disc 96 configured to shield the opening 19. The base portion 96 can include multiple supporting legs for forming gaps between the supporting legs to allow the fluid to flow. One end of the pipeline portion 94 extends into the exhaust joint 18 or in the vicinity of the exhaust joint 18, and the other end of the pipeline portion 94 is fixed on the base portion 92 and faces to the valve disc 96. In a normal operation of the compressor, the fluid discharged from the exhaust port 88 pushes upwardly the valve disc 96 to make the valve disc 96 abut against an inside surface of the base portion 96, and the discharged fluid flows into the high-pressure side through the gaps between the individual supporting legs of the base portion and is thus discharged through the exhaust joint 18. When the compressor is shut down, fluid may flow from the exhaust joint 18 to the high-pressure side. In this case, a part of the backflow fluid will directly act on a surface of the valve disc 96 through the pipeline portion 94, and therefore, push the valve disc 96 quickly and downwardly such as to abut against the opening 19 of the partition plate 15. Hence, the pressure from the backflow fluid is prevented from acting on the fixed scroll component.

The end of the driving shaft 30 that is supported by the lower bearing housing 50 can include an oil hole 32. Preferably, the oil hole 32 is concentric with a rotation axis of the driving shaft 30, and thus can be referred to as a concentric hole 32. The driving shaft 30 may further include an eccentric hole 34. The eccentric hole 34 is in fluid communication with the concentric hole 32, is eccentric relative to the concentric hole 32 and extends substantially to an end face of the eccentric crank pin 36 along a longitudinal direction of the driving shaft. An oil pumping device 56 can be provided at the end of the driving shaft 30 at which the concentric hole 32 is arranged. For example, the oil pumping device 56 can be any appropriate device such as a rotor pump, a vane pump, an oil fork or the like.

With the above configuration, when the compressor operates, lubricating oil located at the bottom of the housing 12 is firstly supplied to the concentric hole 32 of the driving shaft 30 by the oil pumping device 56, and then is supplied to an end of the eccentric crank pin 36 via the eccentric hole 34 in communication with the concentric hole 32. Then, the lubricating oil discharged from the eccentric crank pin 36 can be supplied under the gravity or splashed by movable components to various components in the compressor, so as to achieve lubrication and cooling. Furthermore, drops of the splashed lubricating oil can be mixed with the fluid flowing in through the intake joint and can be carried by the fluid so as to enter the compressing mechanism and the high-pressure side, thereby lubricating and cooling the scroll components and other components.

In order to achieve an axial sealing between a top end of the spiral vane 86 of the fixed scroll component 80 and the end plate 72 of the movable scroll component 70, and between a top end of the spiral vane 76 of the movable scroll component 70 and the end plate 82 of the fixed scroll component 80, generally, a recess 84 is arranged at a side of the end plate 82 of the fixed scroll component 80 that is opposite to the spiral vane 86. A sealing assembly 85 is arranged in the recess 84, and an axial displacement of the sealing assembly 85 is limited by the partition plate 15. A space between the recess 84 and the sealing assembly 85 constitutes a backpressure cavity of the fixed scroll component 80. The backpressure cavity is in fluid communication with the medium pressure pocket via an axially extending communicating passage 83 formed in the end plate 82, so as to apply a force to the fixed scroll component 80 to press the movable scroll component 70. Since the movable scroll component 70 is supported at one side thereof by the upper portion of the main bearing housing 40, the fixed scroll component 80 and the movable scroll component 70 can be effectively pressed together under the pressure in the backpressure cavity. When the pressures in the individual compression pockets each exceed a set value, a resultant force generated by the pressures in the compression pockets will exceeds a downward pressure provided in the backpressure cavity, so that the fixed scroll component 80 moves upwardly. In this case, the fluid in the compression pocket will leak to the low-pressure side through the gap between the top end of the spiral vane 86 of the fixed scroll component 80 and the end plate 72 of the movable scroll component 70 and the gap between the top end of the spiral vane 76 of the movable scroll component 70 and the end plate 82 of the fixed scroll component 80, so as to perform unloading, thus providing the scroll compressor with an axial flexibility.

Figures 3A, 3B:
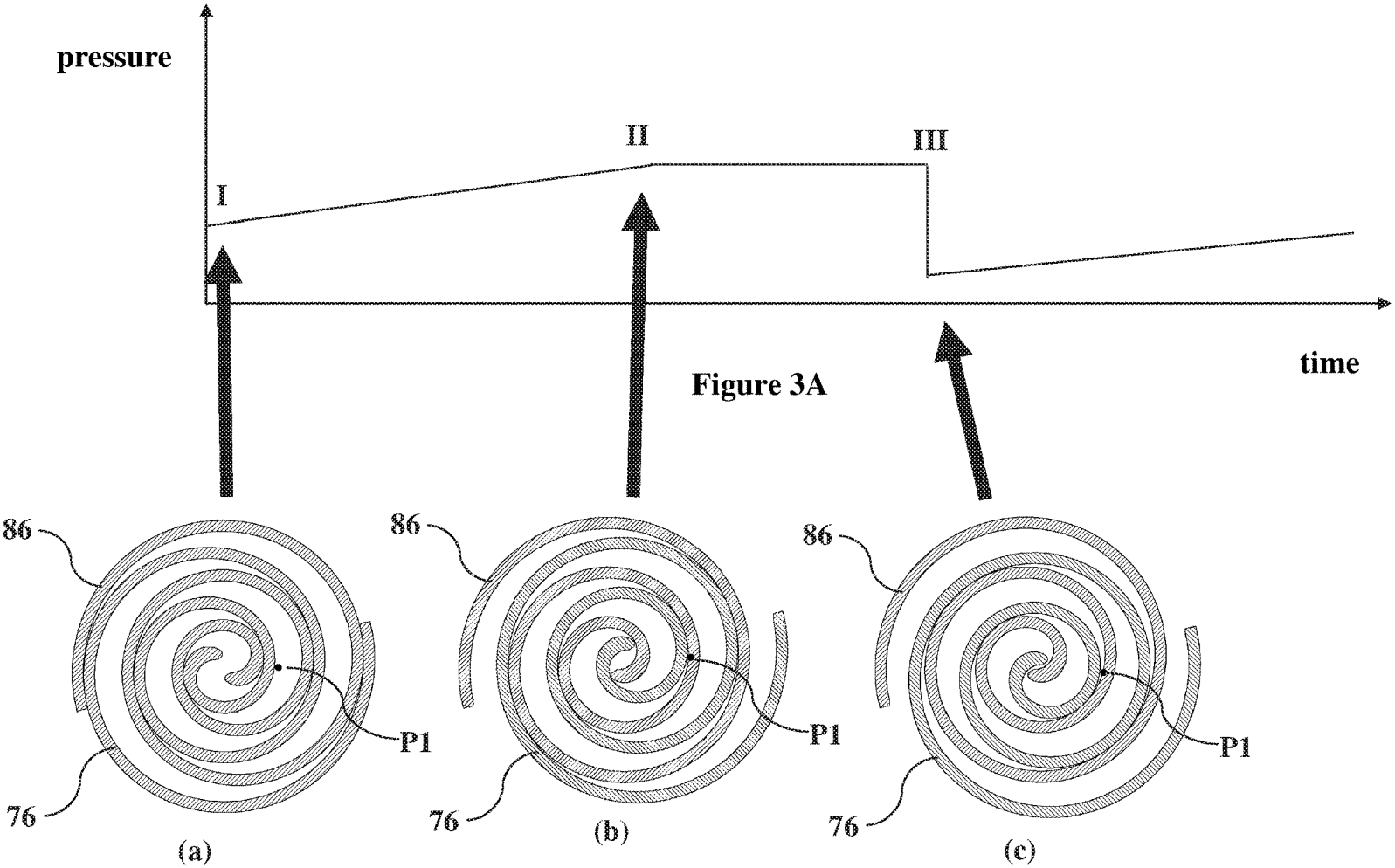
FIG. 3A is a schematic view showing the variation of pressure in a backpressure cavity.
FIG. 3B is a schematic view showing the variation of a compression pocket corresponding to the variation of backpressure in FIG. 3A.

The inventor of the application has found that, since an intermittent communication is provided between the backpressure cavity and the medium pressure pocket by the communicating passage 83, there is a fluctuation in the pressure in the backpressure cavity. As shown in FIGS. 3A and 3B, when the fixed scroll component 80 and the movable scroll component 70 are located at a relative position (a), the pressure at point P1 corresponds to a pressure I in FIG. 3A. As the movable scroll component 70 orbits, the pressure at P1 gradually increases and reaches a maximum pressure II at a relative position (b). After the maximum pressure II is maintained for a period of time, a large pressure drop II occurs at P1 at a relative position (c). With the operation of the compressor, the backpressure provided in the backpressure cavity circularly fluctuates.

However, when the compressor operates in a hash working condition, the fluctuation of the backpressure may sometimes cause an insufficient backpressure, thus deteriorating the performance of the compressor.

Figure 15:
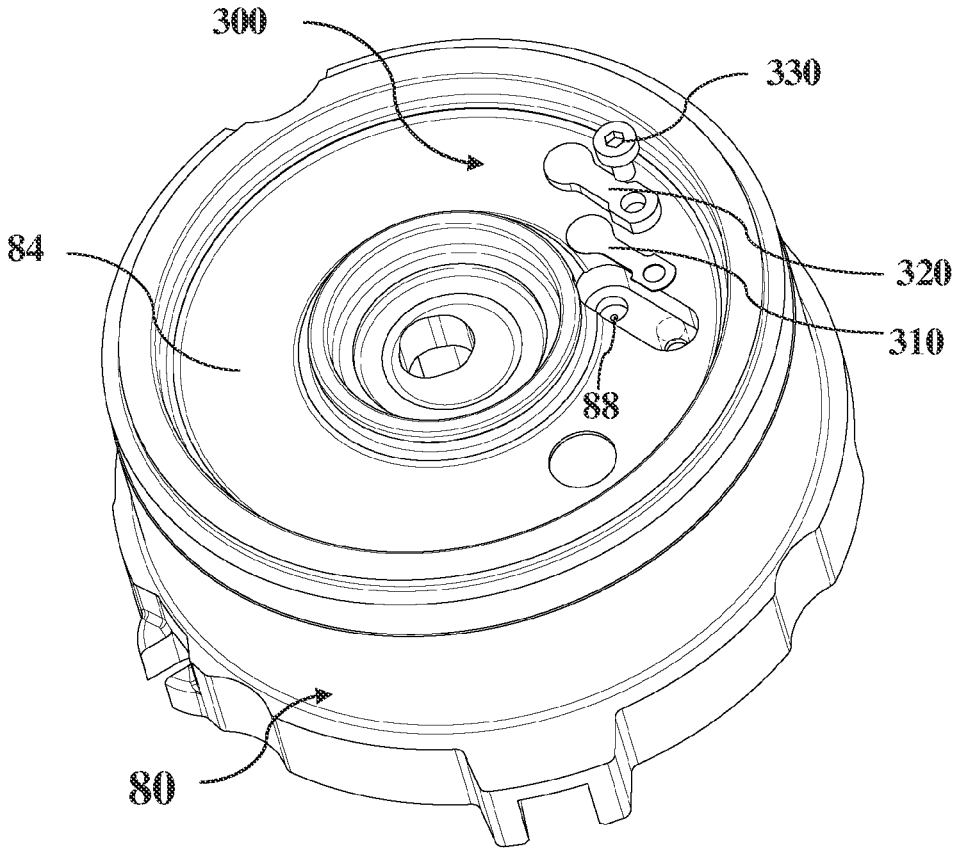
FIG. 15 is an exploded perspective view of another embodiment of the disclosure.

In order to solve the problem described above, in an embodiment, the applicant proposes to provide a check valve 300 in the communicating passage between the backpressure cavity and the medium pressure pocket, as shown in FIG. 15. The check valve 300 has a valve disc 310 which can cover an end of the communicating passage 83. The valve disc 310 can be made of an elastic material, for example, metallic elastic material. In this way, when the pressure in the medium pressure pocket is higher than the pressure in the backpressure cavity, the fluid in the medium pressure pocket can push away the valve disc 310 and flow into the backpressure cavity. When the pressure in the backpressure cavity is higher than that in the medium pressure pocket, the valve disc 310 can close the communicating passage 83, and thus the fluid in the backpressure cavity cannot flow into the medium pressure pocket. Therefore, regardless of the working condition, sufficient backpressure can be provided. Moreover, in order to further prevent an excessive deformation of the valve disc 310, a valve guard 320 can be arranged at a side of the valve disc 310 that is opposite to the end of the communicating passage 83. The check valve 300 constituted by the valve disc 310 and the valve guard 320 can be fixed on the fixed scroll component 80 via for example a fastener 330.

Although a check valve is generally understood as a valve device that allows fluid to flow in one direction and prevents the fluid from flowing in an opposite direction, the person skilled in the art may note that, in the concept of the disclosure, even if the check valve allows a small amount of fluid to flow therethrough in the opposite direction described above, it is also workable and can achieve a good effect. For example, one or more small hole can be provided in the valve disc of the check valve, or a gap may be formed between the valve disc and the valve seat of the check valve (in the example of FIG. 15, the valve seat can be a wall face around the end of the communicating passage 83). In other words, in the above example, the check valve can be replaced by a throttle valve capable of preventing or reducing the backflow of fluid from the backpressure cavity to the compression pocket.

Accordingly, the inventor of the application has found that, if such a check valve is provided, when the compressor returns to a lighter-load working condition from a worse working condition or a heavier-load working condition, the pressure in the backpressure cavity cannot be released due to the barrier of the check valve, resulting in an excessive backpressure and increase of the wear of the compressor and power consumption.

In view of this, the inventor of the application further provides a pressure control valve capable of providing a function of bi-direction flow of fluid according to the pressure difference across the valve.

Figure 4A:
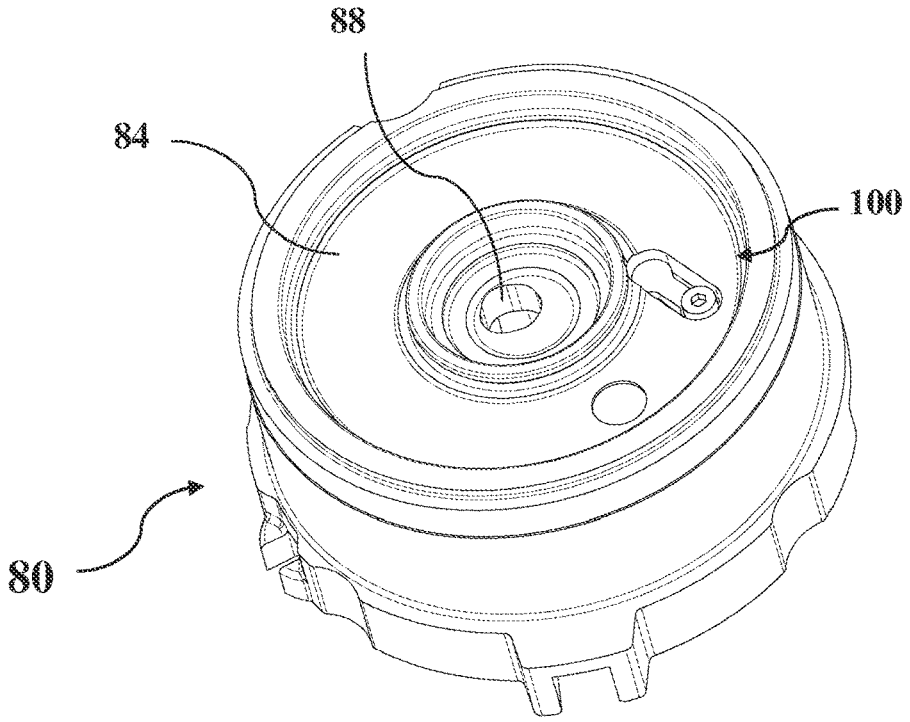
FIG. 4A is an assembled perspective view of a fixed scroll component including a pressure control valve according to a first embodiment.
Figure 4B:
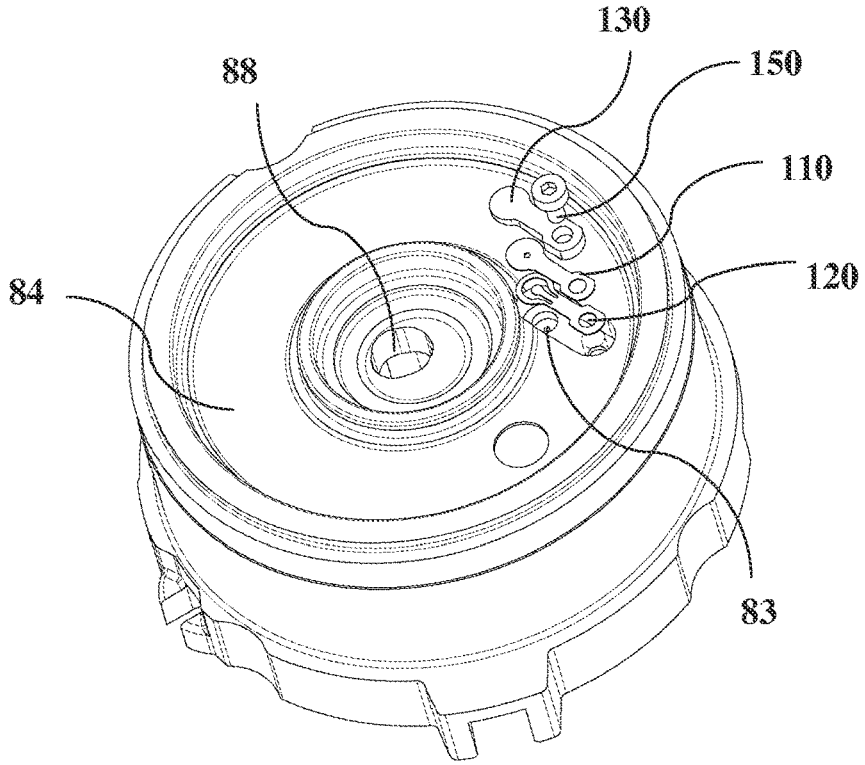
FIG. 4B is an exploded perspective view of the pressure control valve and the fixed scroll component in FIG. 4A.
Figure 6A:
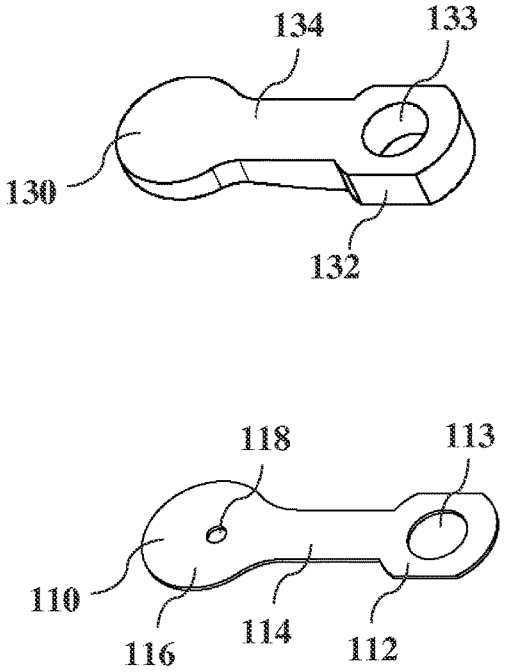
FIG. 6A is a perspective view of a first valve disc member, a second valve disc member and a valve guard.
Figure 6B:
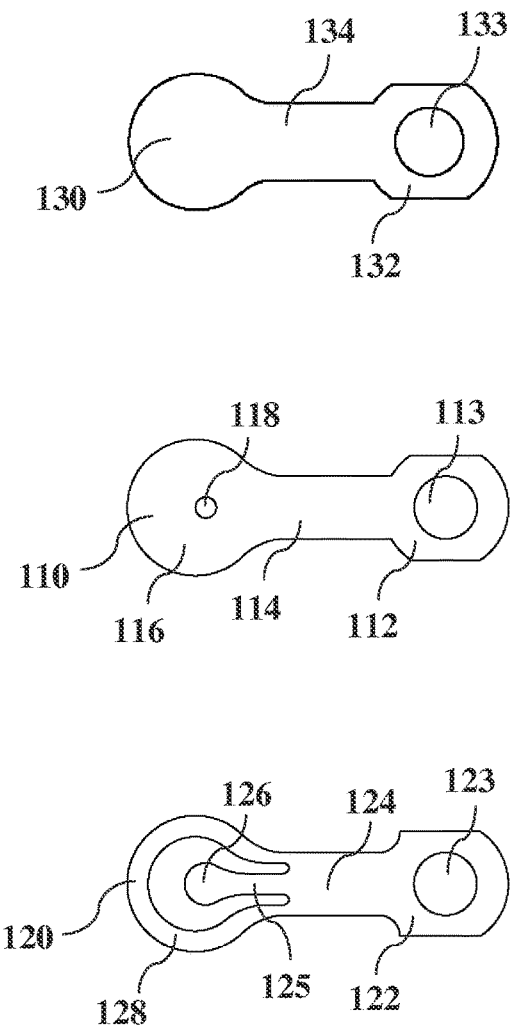
FIG. 6B is a top view of the first valve disc member, the second valve disc member and the valve guard.

FIGS. 1 and 2 show a pressure control valve 100 according to a first embodiment of the disclosure arranged in a communicating passage 83. FIG. 4A further shows a perspective view of a fixed scroll component 80 on which a pressure control valve 100 is mounted. As shown in an exploded perspective view of FIG. 4B, the pressure control valve 100 may include a first valve disc member 110 and a second valve disc member 120. The first valve disc member 100 can be configured to shield or close the communicating passage 83. As shown in FIGS. 6A and 6B, a fluid passage 118 can be formed on the first valve disc member 100. The second valve disc member 120 can be configured to shield or close a fluid passage 83 in the first valve disc member 110.

Specifically, the first valve disc member 110 may include a base portion 112, an elastic neck portion 114 extending from the base portion 112, and a head portion 116 connected with the neck portion 114. The head portion 116 can be configured to shield or close the communicating passage 83. In an example shown in Figures, the fluid passage 118 in the first valve disc member 110 can be formed by a through hole formed in the head portion 116. However, it should be understood by the person skilled in the art that the fluid passage 118 can be formed by multiple through holes.

The second valve disc member 120 can include a base portion 122, an elastic neck portion 124 extending from the base portion 122, a tongue portion 126 connected with the neck portion 124, and a rim portion 128 connected with the neck portion 124 and surrounding the tongue portion 126. The tongue portion 126 can be connected to the neck portion 124 via a neck portion 125 of the tongue portion 126. The area of the tongue portion 126 can be smaller than that of the head portion 116. The tongue portion 126 can be configured to shield or close the fluid passage 118 of the first valve disc member 110 and is movable in a direction away from the first valve disc member 110. Correspondingly, the first valve disc member 110 is movable in a direction away from the second valve disc member 120 or the communicating passage 83. The first valve disc member 110 and the second valve disc member 120 are generally provided with return elasticity by the respective neck portions 114 and 124. However, it should be understood by the person skilled in the art that it is possible for any part of the first valve disc member and the second valve disc member to provide such return elasticity.

The pressure control valve 100 may further include a valve guard member 130 for limiting the displacement of the first valve disc member 110. The valve guard member 120 may include a base portion 132 and a stopping portion 134 extending from the base portion 132. It should be understood by the person skilled in the art that the valve guard member 130 is not necessary, but can be omitted.

The first valve disc member 110 and the second valve disc member 120 can be mounted one above the other in the communicating passage 83 of the fixed scroll component 80, so that the rim portion 128 of the second valve disc member 120 abuts against a stepped portion around the communicating passage 83, and the head portion 110 of the first valve disc member 110 is superposed on the tongue portion 126 and the rim portion 128 of the second valve disc member 120.

Figure 5A:
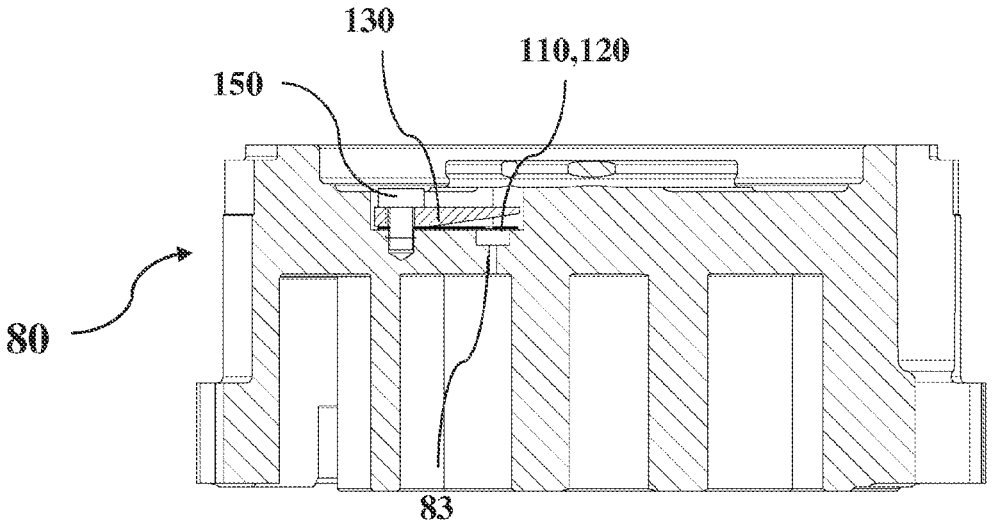
FIG. 5A is a partial longitudinal sectional view of the pressure control valve and the fixed scroll component.
Figure 5B:
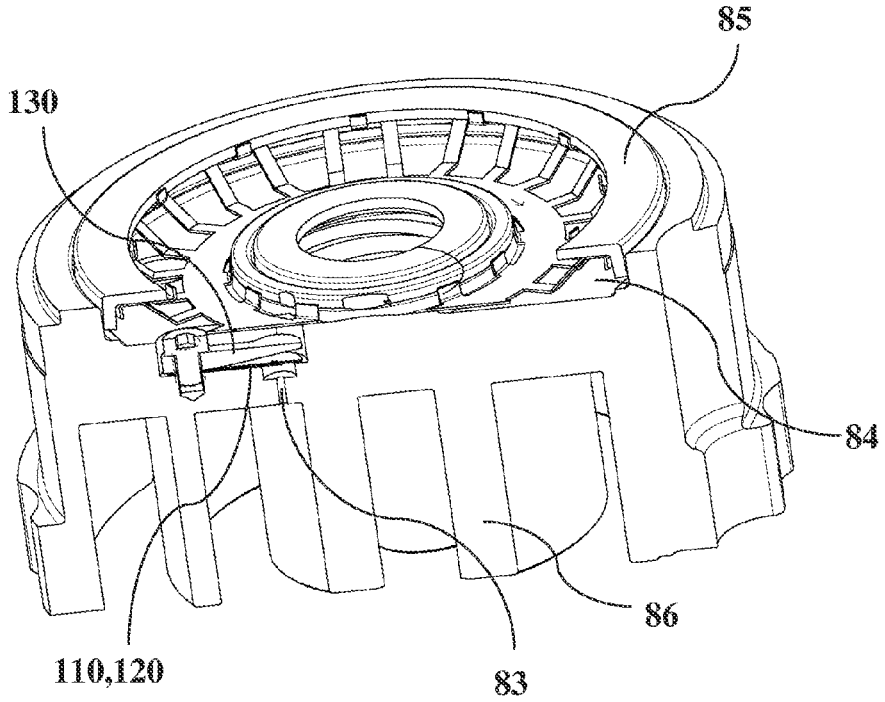
FIG. 5B is a partially cutaway perspective view of the pressure control valve and the fixed scroll component.

In an example shown in FIGS. 5A and 5B, the valve guard member 130, the first valve disc member 110 and the second valve disc member 120 are fixed on the fixed scroll component 80 by inserting a fastener 150 such as pin into respective fixing holes 133, 113 and 123.

The first valve disc member 110 and the second valve disc member 120 each can be a stamped member punched out from a metal sheet or a moulded member moulded from elastic material. Hence, the first valve disc member 110 and the second valve disc member 120 can be easily manufactured at a low cost. It should be understood by the person skilled in the art that the first valve disc member and the second valve disc member can be made of different materials or can be made of the same material with different thickness.

It is assumed that a direction directed to the first valve disc member 110 from the second valve disc member 120 is set as a first direction. In the pressure control valve 100 with such configuration, when a pressure difference across the first valve disc member 110 and the second valve disc member 120 (that is, a pressure difference between the medium pressure pocket and the backpressure cavity) is directed to the first direction and is greater than or equal to a first predetermined value, the first valve disc member 110 moves in the first direction so as to be opened to allow fluid to flow through the pressure control valve. When a pressure difference across the first valve disc member 110 and the second valve disc member 120 is directed to a second direction opposite to the first direction and is greater than or equal to a second predetermined value, the second valve disc member 120 moves in the second direction so as to be opened to allow fluid to flow through the pressure control valve.

The first predetermined value and the second predetermined value can be set to be the same or different from each other. For example, the second predetermined value can be set to be greater than or equal to the first predetermined value. Alternatively, the second predetermined value can be set to be smaller than the first predetermined value. Hence, the pressure control valve 100 can be easily used in various applications.

In the pressure control valve 100 according to the present embodiment, the first predetermined value can be set by setting at least one of the elasticity and a pressure receiving area of the first valve disc member 110. For example, the first predetermined value can be easily changed or set by changing the property of material or the property of the shape of the first valve disc member 110 (for example, the thickness and the width of the neck portion 114), or by changing the pressure receiving area of the first valve disc member 110, or by changing the both. In an example shown in FIG. 6A, the pressure receiving area of the first valve disc member 110 can be defined, for example, by the area between the rim portion 128 and the tongue portion 126 of the second valve disc member 120. Here, the pressure receiving area can be understood as an area of the first valve disc member 110 being subject to the pressure of the fluid. Since the rim portion 128 and the tongue portion 126 of the second valve disc member 120 shield a part of the first valve disc member 110 and since the second valve disc member itself can absorb a certain amount of force, the pressure receiving area of the first valve disc member 110 can be substantially equal to the area between the rim portion 128 and the tongue component 126 of the second valve disc member 120.

Similarly, the second predetermined value can be set, for example, by setting at least one of the elasticity of the second valve disc member 120 (for example, particularly the thickness, the width or the material of the neck portion 125 of the tongue portion 126 itself) and the area of the fluid passage 118.

By reasonably setting the first predetermined value and the second predetermined value, the pressure difference between the medium pressure pocket and the backpressure cavity can be reasonably controlled, thereby reducing the pressure fluctuation in the backpressure cavity on the one hand, and optimizing the performance of operation of the compressor by providing a variable backpressure according to the working condition of the compressor on the other hand.

For example, when the compressor 10 is in a normal operation or is turned to a heavier-load working condition from a lighter-load working condition, the pressure in the medium pressure pocket is greater than that in the backpressure cavity, thereby forming a pressure difference in a first direction. When the pressure difference reaches the first predetermined value, the first valve disc member 110 is opened, so that the fluid in the medium pressure pocket flows into the backpressure cavity to apply an appropriate backpressure to the fixed scroll component 80. Furthermore, due to the presence of the pressure control valve 100, when the pressure difference in the second direction between the backpressure cavity and the medium pressure pocket is lower than for example the second predetermined value, the second valve disc member 120 cannot be opened, and thus no fluid flows between the backpressure cavity and the medium pressure pocket, thereby avoiding the pressure fluctuation in the backpressure cavity. When the compressor is turned back to the lighter-load working condition from the heavier-load working condition, the pressure difference in the second direction between the backpressure cavity and the medium pressure pocket may be greater than the second predetermined value. In this case, the second valve disc member 120 is opened to allow the fluid in the backpressure cavity to flow into the medium pressure pocket so as to achieve the pressure relief in the backpressure cavity. In such case, a relative low pressure can be maintained in the backpressure cavity, thus a contacting pressure between the fixed scroll component 80 and the movable scroll component 70 can be reduced, thereby reducing the wear therebetween.

In the example shown in FIGS. 5A and 5B, the first valve disc member 110 is configured to shield the communicating passage 83 via the rim portion 128 of the second valve disc member 120. However, it should be understood by the person skilled in the art that the rim portion 128 can be omitted, and the first valve disc member 110 can directly shield the communicating passage 83.

Additionally, in the example shown in FIGS. 6A and 6B, the fluid passage 118 is formed in the head portion 116 of the first valve disc member 110. However, the fluid passage 118 also can be formed at other appropriate position, for example in the neck portion 114. Accordingly, the position of the tongue portion 126 of the second valve disc member 120 can be correspondingly changed, and a space for deformation of the tongue portion 126 can be provided in the communicating passage 83.

Figure 7:
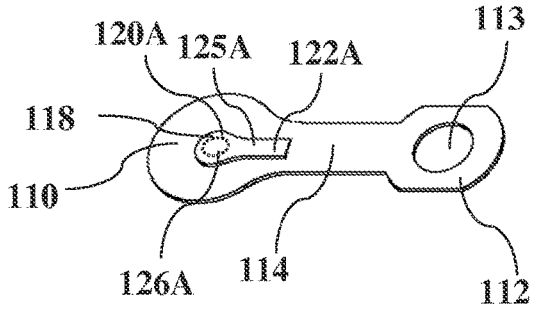
FIG. 7 is a perspective view of a variation of the first valve disc member and the second valve disc member according to the first embodiment.

In the example shown in FIGS. 6A and 6B, the first valve disc member 110 and the second valve disc member 120 are separately formed and then are fixed together via a fastener 150. However, in a variation of the present embodiment, the first valve disc member can be integrally formed with the second valve disc member. For example, the first valve disc member and the second valve disc member can be directly formed into one piece by moulding process. Alternatively, the first valve disc member and the second valve disc member can be separately formed and then are joined together by any proper connecting means (for example welding, sticking, riveting or the like). For example, FIG. 7 shows a bottom perspective view of a variation of the first valve disc member 110 and the second valve disc member 120A. The first valve disc member 110 can have the same configuration as that of the first valve disc member in FIG. 6A. The second valve disc member 120A can include a base portion 122A, an elastic neck portion 125A extending from the base portion 122A, and a tongue portion 126A connected with the neck portion 125A. The base portion 122A for example can be welded on the neck portion 114 of the first valve disc member 110, and the tongue portion 126A can be configured to shield the fluid passage 118 of the first valve disc member 110. With the first valve disc member and the second valve disc member with such configuration, the number of the components of the pressure control valve can be further reduced, and the structure of the pressure control valve can be simplified. For the pressure control valve according to the present variation, the pressure receiving area of the first valve disc member 110 that can be used in setting the first predetermined value can be defined by the overlapped area between the first valve disc member 110 and the communicating passage 83.

Figure 8A:
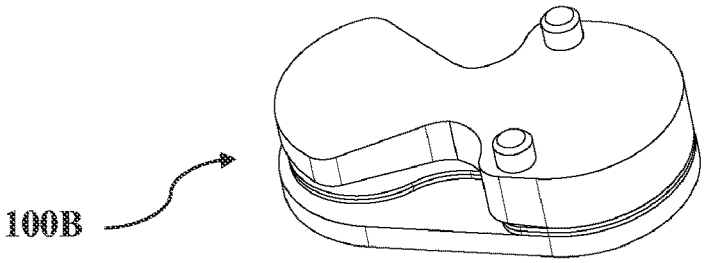
FIG. 8A is an assembled perspective view of a pressure control valve according to another variation of the first embodiment.
Figure 8B:
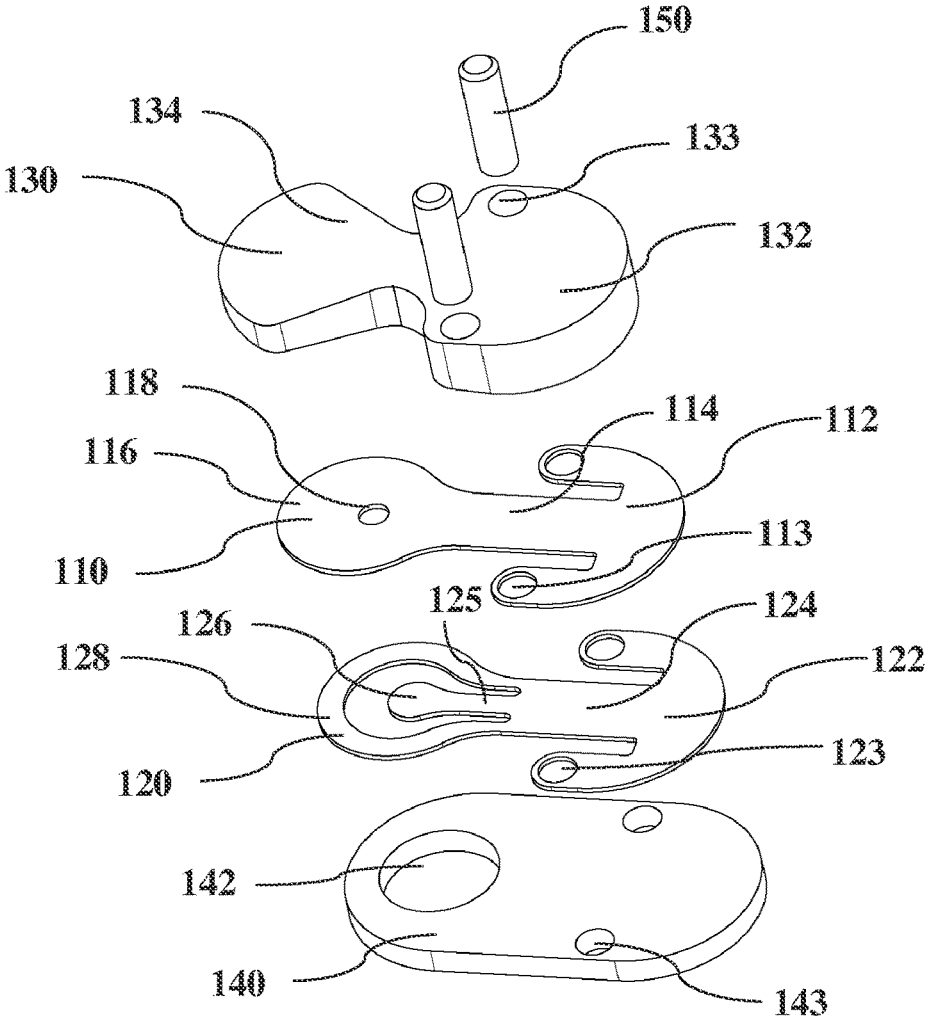
FIG. 8B is an exploded perspective view of the pressure control valve of FIG. 8A.

In the example shown in FIGS. 5A and 5B, in the pressure control valve 100, a part of the fixed scroll component 80 around the communicating passage 83 can be used as a valve seat, and the communicating passage 83 can be used as a valve hole. According to another variation of the present embodiment, the pressure control valve can be formed to be an independent assembly. For example, as shown in FIGS. 8A and 8B, a pressure control valve 100B can include a first valve disc member 110, a second valve disc member 120, a valve guard member 130 and a valve seat 140. A valve hole 142 is formed in the valve seat 140. In the present variation, the valve guard member 130, the first valve disc member 110, the second valve disc member 120 and the valve seat 140 are fixed together by inserting two fasteners 150 into respective fixing holes 133, 113, 123 and 143. The pressure control valve 100B according to the present variation as the independent assembly can be directly fitted in the communicating passage 83 of the fixed scroll component 80. Other configuration and operating principle of the pressure control valve 100B according to the present variation are substantially the same as that of the embodiment descried with reference to the FIGS. 5A, 5B, 6A and 6B, which will not be described herein.

Figure 9A:
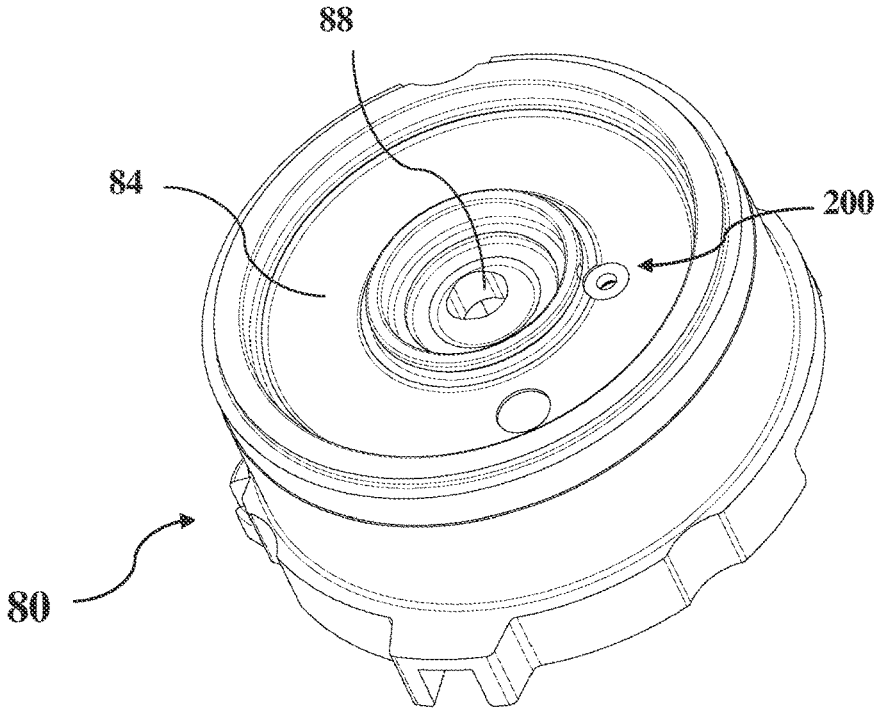
FIG. 9A is an assembled perspective view of a fixed scroll component including a pressure control valve according a second embodiment.

FIGS. 9A to 11 show a pressure control valve 200 according to a second embodiment. FIG. 9A shows a perspective view of a fixed scroll component 80 in which a pressure control valve 200 according to the present embodiment is mounted, and FIG. 9B shows an exploded perspective view of the pressure control valve 200.

Figure 9B:
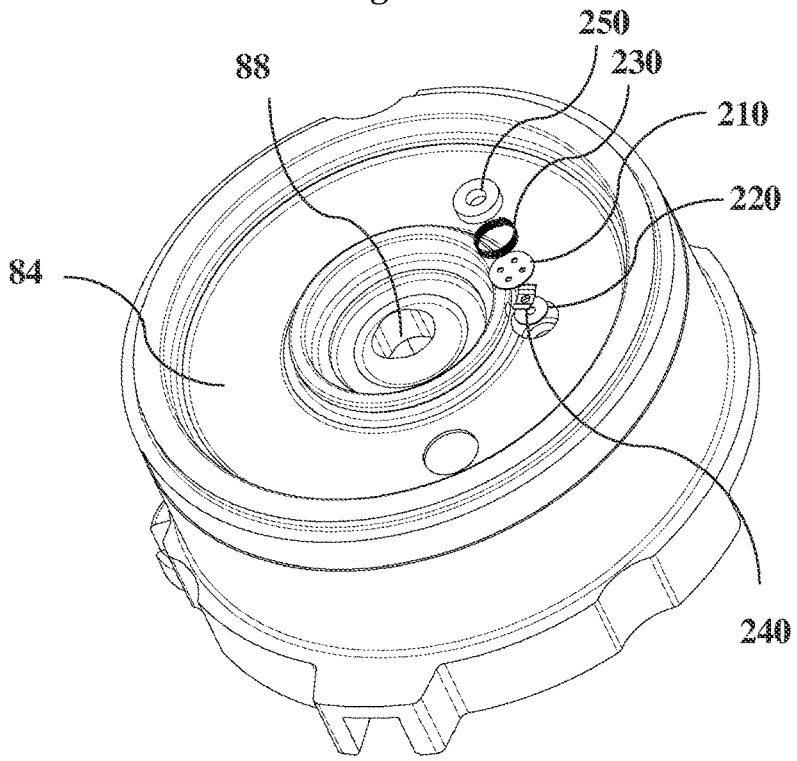
FIG. 9B is an exploded perspective view of the pressure control valve and the fixed scroll component in FIG. 9A.
Figure 10A:
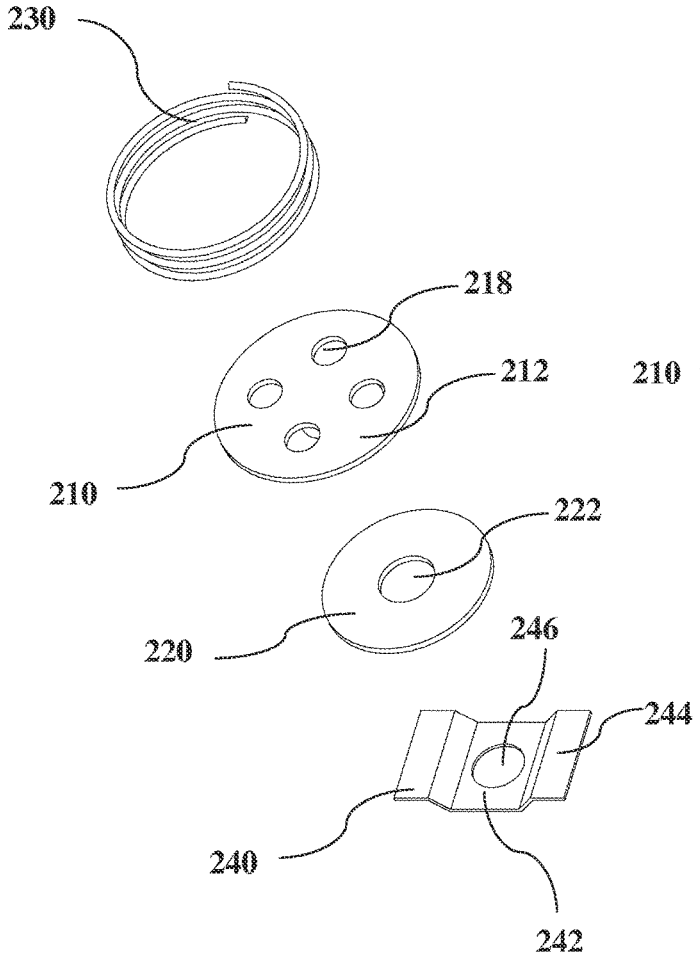
FIG. 10A is a perspective view of a first valve disc member, a second valve disc member, a first elastic member and a second elastic member.
Figure 10B:
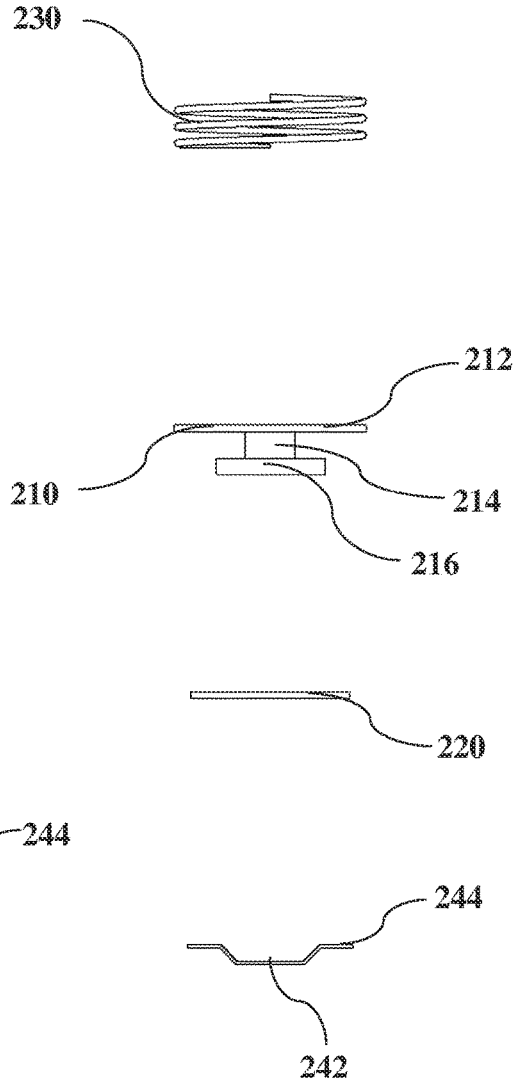
FIG. 10B is a side view of the first valve disc member, the second valve disc member, the first elastic member and the second elastic member.

Referring to FIGS. 9B, 10A and 10B, the pressure control valve 200 may include a first valve disc member 210, a second valve disc member 220, a first elastic member 230 for biasing the first valve disc member 110, and a second elastic member 240 for biasing the second valve disc member 220. The first valve disc member 210, the second valve disc member 220, the first elastic member 230 and the second elastic member 240 are fixed in the communicating passage 83 by for example a retaining ring 250.

More specifically, the first valve disc member 210 can include a body portion 212 configured to shield the communicating passage 83, an extending portion 214 extending from the body portion 212 in a second direction (that is, a direction oriented from the first valve disc member 210 to the second valve disc member 220, or a direction oriented from the backpressure cavity to the medium pressure pocket), and a protruding portion 216 protruding radially outwardly from the extension portion 214. The fluid passage 218 can be formed by at least one through hole formed in the body portion 212.

A through hole 222 for passage of the extension portion 214 of the first valve disc member 210 can be formed in the second valve disc member 220.

The first elastic member 230 can be arranged between the first valve disc member 210 and the retaining ring 250 to bias the first valve disc member 210 to shield or close the communicating passage 83. The second elastic member 240 is arranged between the second valve disc member 220 and the protruding portion 216 to bias the second valve disc member 220 to shield or close the fluid passage 218.

Figure 11:
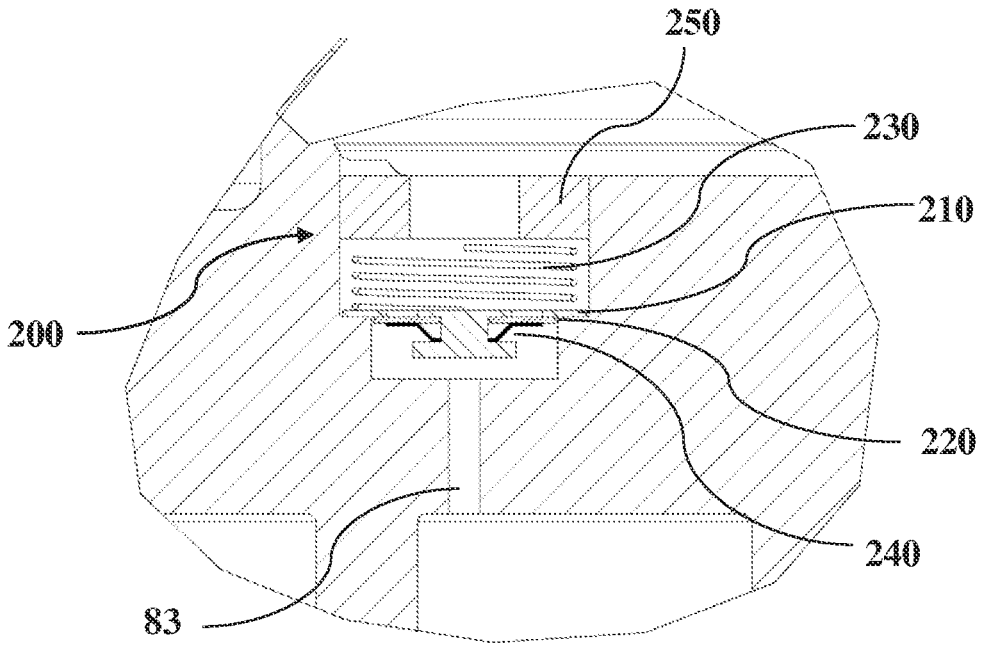
FIG. 11 is a partial sectional view of a fixed scroll component on which the pressure control valve according to the second embodiment is mounted.

FIG. 11 shows a partial sectional view of a fixed scroll component 80 in which a pressure control valve 200 according the present embodiment is mounted. Similarly, when a pressure difference across the first valve disc member 210 and the second valve disc member 220 (that is, a pressure difference between the medium pressure pocket and the backpressure cavity) is directed to a first direction (that is, a direction that is directed to the backpressure cavity from the medium pressure pocket) and is greater than or equal to the first predetermined value, the first valve disc member 210 moves in the first direction against the elastic force of the first elastic member 230 so as to be opened, thereby allowing the fluid to flow through the pressure control valve. In this case, due to the action of the protruding portion 216 of the first valve disc member 210 and the second elastic member 240, the second valve disc member 220 also is moved with first valve disc member 210 along the first direction. When the pressure difference across the first valve disc member 210 and the second valve disc member 220 is directed to a second direction opposite to the first direction and is greater than or equal to the second predetermined value, the periphery of the first valve disc member 210 is supported by a stepped portion around the communicating passage 83 and cannot move along the second direction, but the second valve disc member 220 can move along the second direction against the elastic force of the second elastic member 240 so as to be opened, thereby allowing the fluid to flow through the pressure control valve.

In the present embodiment, similarly, the first predetermined value can be set by setting at least one of the elasticity (for example, spring constant) of the first elastic member and a pressure receiving area of the first valve disc member, and the second predetermined value can be set by setting at least one of the elasticity (for example, spring constant) of the second elastic member and the area of the fluid passage. Here, since when the first valve disc member 210 opens along the first direction, the second valve disc member 220 may move with the first valve disc member 210, the pressure of the fluid acting on the second valve disc member 220 may be transmitted to the first valve disc member 210. Hence, the pressure receiving area of the first valve disc member 210 can be defined by the overlapped area between the first valve disc member 210 and the communicating passage 83.

Figure 12A:
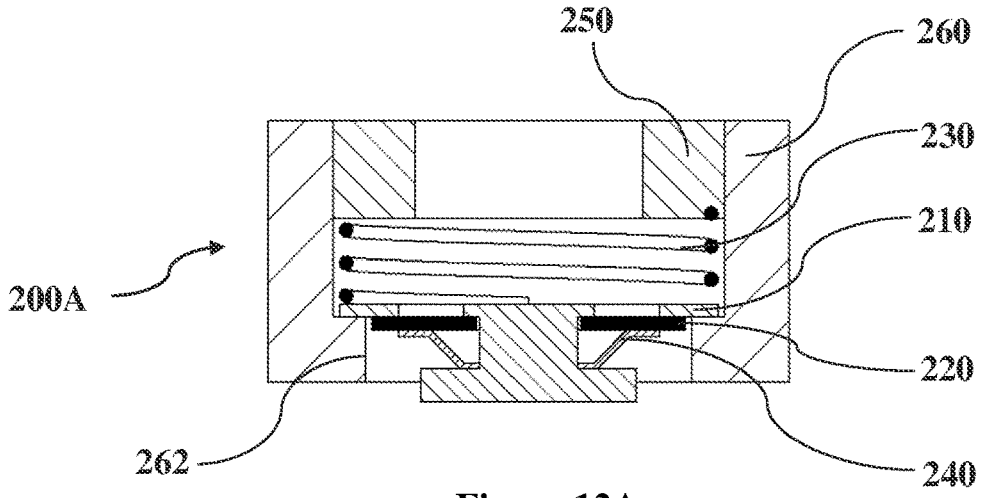
FIG. 12A is an assembled perspective view of a pressure control valve according to a variation of the second embodiment.
Figure 12B:
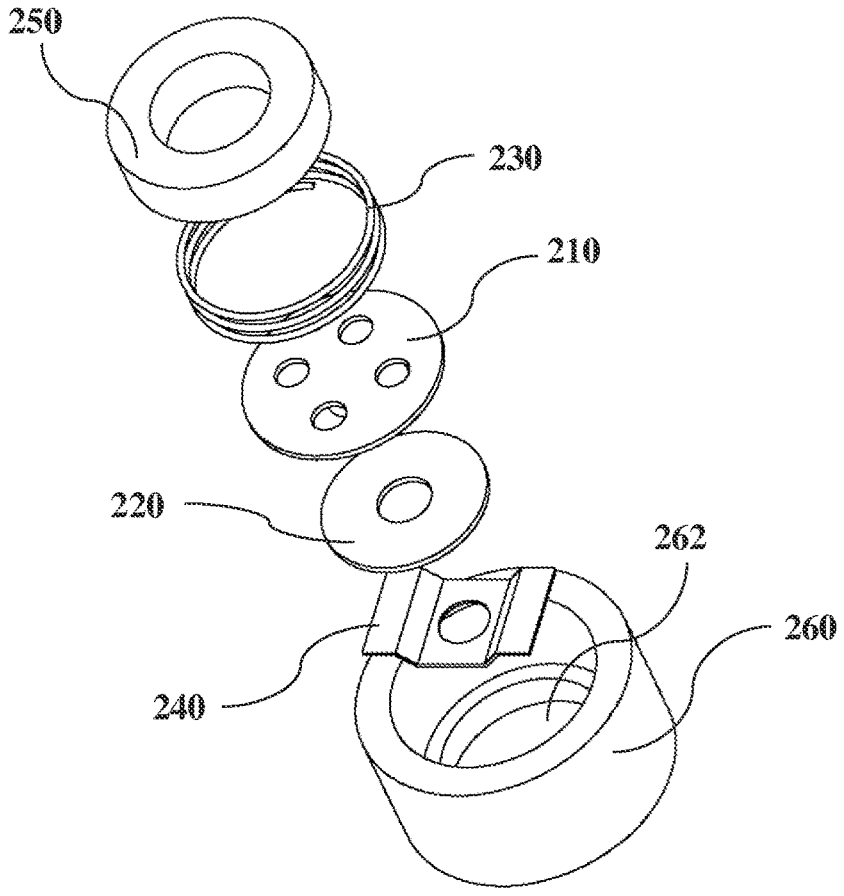
FIG. 12B is an exploded perspective view of the pressure control valve of FIG. 12A.
Figure 13:
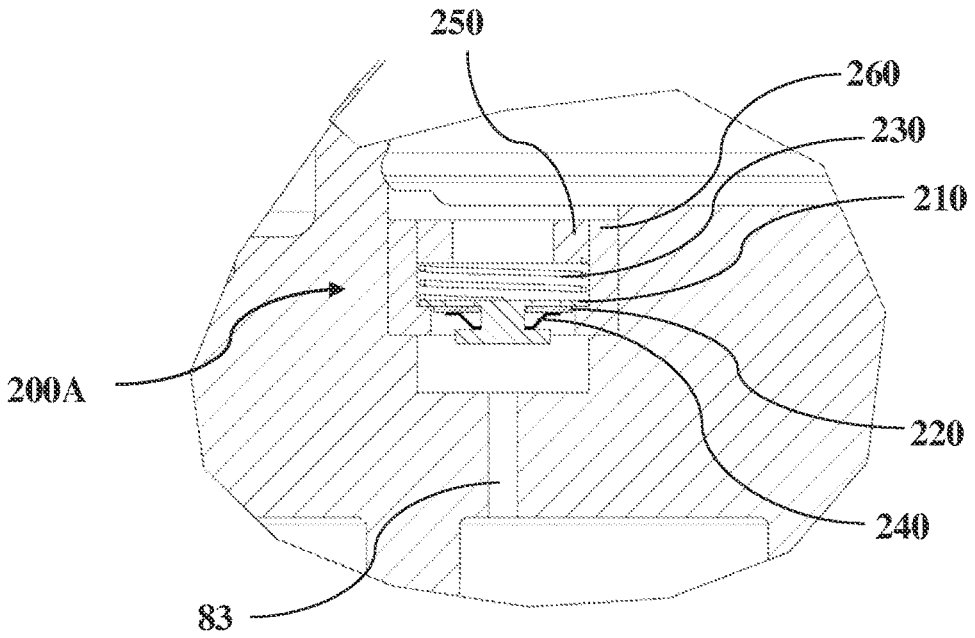
FIG. 13 is a partial sectional view of a fixed scroll component on which the pressure control valve according to the variation shown in FIG. 12A is mounted.

In an example shown in FIGS. 9A and 9B, in the pressure control valve 200, a part of the fixed scroll component 80 around the communicating passage 83 is used as a valve seat, and the communicating passage 83 can be used as a valve hole. According to a variation of the present embodiment, the pressure control valve can be formed to be an independent assembly. For example, as shown in FIGS. 12A and 12B, the pressure control valve 200A can further include a valve seat 260. A valve hole 262 is formed in the valve seat 260. A first valve disc member 210, a second valve disc member 220, a first elastic member 230 and a second elastic member 240 can be retained in the valve seat 260 by a retaining ring 250, so as to form an independent assembly. As shown in FIG. 13, the pressure control valve 200A according to the present variation as the independent assembly can be directly fitted in the communicating passage 83 of the fixed scroll component 80. Other configuration and operation principle of the pressure control vale 200A according to the present variation are substantially the same as that of the embodiment described with reference to FIG. 11, which will not be described here.

In an example shown in FIG. 10A, the first elastic member 230 is formed by a helical spring, and the second elastic member 240 is formed by a spring bracket. It should be understood by the person skilled in the art that, the first elastic member and the second elastic member are not limited to this, but can have other proper forms. For example, the first elastic member can be formed as an elastic support, an elastic retaining ring or a leaf spring, and the second elastic member can be formed as a helical spring, an elastic retaining ring or a leaf spring.

In an example shown in FIG. 11, a first elastic member 230 is arranged between a retaining ring 250 and a first valve disc member 210. It should be understood by the person skilled in the art that the retaining ring 250 can be omitted and the first elastic member can be directly fixed relative to a fixed scroll component. Furthermore, in the example shown in FIG. 11, a second elastic member is arranged between a second valve disc member and a protruding portion of the first valve disc member. It can be understood by the person skilled in the art that the protruding portion 216 and/or the extending portion 214 can be omitted and the second elastic member can be directly fixed relative to the fixed scroll component. For example, the second elastic member can be arranged between the second valve disc member and a stepped portion around the communicating passage 83. Similarly, for a variation shown in FIG. 12A, the protruding portion 216 and/or the extending portion 214 can be omitted, and the second elastic member can be arranged between the second valve disc member and the stepped portion of the valve seat.

Figure 14:
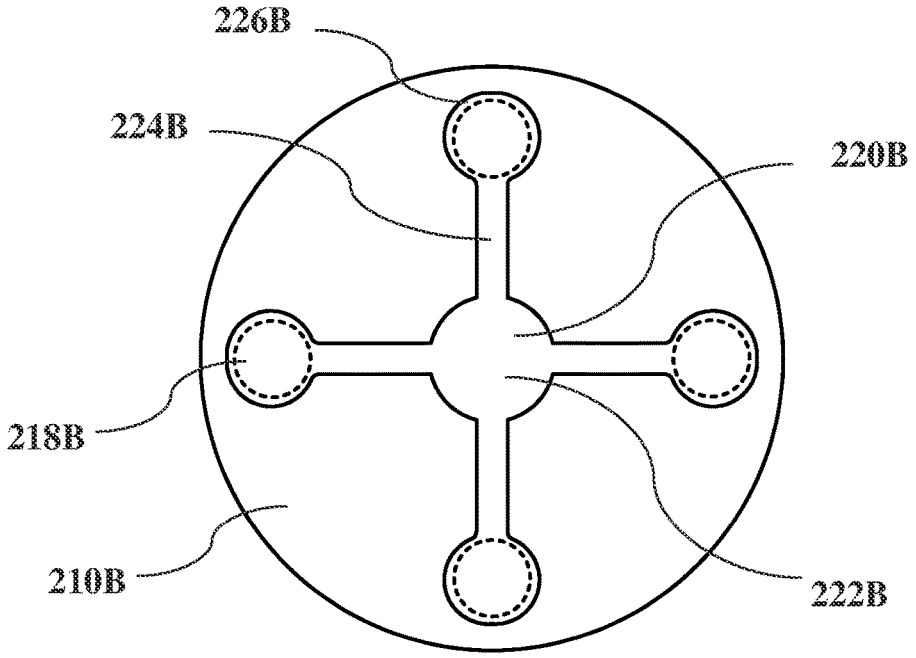
FIG. 14 is a plane view of a variation of the second embodiment.

Moreover, the features of the first embodiment and that of the second embodiment can be combined. For example, as shown in FIG. 14, FIG. 14 shows a bottom view of the first valve disc member and the second valve disc member. The second valve disc member 220B can be integrally formed with the first valve disc member 210B. Specifically, a fluid passage formed by at least one through hole 218B can be formed on the first valve disc member 210B. The second valve disc member 220B can include a base portion 222B connected with the first valve disc member 210B, an elastic neck portion 224B extending from the base portion 222B, and a tongue portion 226B connected with the neck portion 224B. The tongue portion 226B can be configured to shield the through hole 218B in the first valve disc member 210B. In an example shown in FIG. 14, it shows that the first valve disc member 210B has four through holes 218B, and correspondingly, the second valve disc member 220B include four neck portions 224B and four tongue portions 226B. However, it should be understood by the person skilled in the art that the number of the though holes, the neck portions and the tongue portions can be changed as desired, for example, the number can be one to three or more. Here, the electric neck portion 224B can be used as the second elastic member. The first valve disc member and the second valve disc member with such configuration can be used in the example shown in FIG. 11 or 13 to replace the first valve disc member, the second valve disc member and the second elastic member therein. Other configurations and operating principles of the present variation are the same as that of the above embodiment, which will not be described here.

Although the pressure control valve and the scroll compressor including the pressure control valve according to the disclosure have been described with reference to a configuration in which the backpressure cavity is arranged on the fixed scroll component, the person skilled in the art should understand that the pressure control valve according to the present disclosure can be used in a scroll compressor in which the backpressure cavity is arranged at the movable scroll component side. Besides, the person skilled in the art will appreciate that the pressure control valve according to the disclosure also can be used in other applications other than the scroll compressor to achieve a bi-direction control of fluid according to a pressure difference across the valve.

While various embodiments and aspects of the disclosure have been described above, the person skilled in the art should understand that further modifications and/or improvements can be made to some aspects of the disclosure.

For example, in some aspects, the first valve disc member can include: a first base portion fixed relative to the valve seat; a first elastic neck portion extending from the first base portion; and a head portion connected with the first neck portion, wherein the head portion can be configured to be able to shield the valve hole, and the fluid passage can be formed by at least one through hole formed in the head portion.

For example, in some aspects, the second valve disc member can include: a second base portion fixed relative to the valve seat; a second elastic neck portion extending from the second base portion; and a tongue portion connected with the second neck portion, wherein the tongue portion can be configured to shield the fluid passage of the first valve disc member and is movable along the second direction.

For example, in some aspects, the area of the tongue portion may be smaller than that of the head portion.

For example, in some aspects, the second valve disc member can further include a rim portion connected with the second neck portion and surrounding the tongue portion. The rim portion abuts against the valve seat around the valve hole, and the head portion of the first valve disc member can be configured to shield the vale hole via the rim portion.

For example, in some aspects, the first predetermined value can be set by setting at least one of the elasticity and a pressure receiving area of the first valve disc member, and the second predetermined value can be set by setting at least one of the elasticity of the second valve disc member and the area of the fluid passage.

For example, in some aspects, the pressure receiving area of the first valve disc member can be defined by an area between the rim portion and the tongue portion of the second valve disc member.

For example, in some aspects, the elasticity of the first valve disc member is mainly provided by the first neck portion, and the elasticity of the second valve disc is mainly provided by the second neck portion.

For example, in some aspects, the pressure control valve can further include a valve guard member for limiting the displacement of the first valve disc member in the first direction.

For example, in some aspects, the valve guard member, the first valve disc member, and the second valve disc member can be fixed on the valve seat by fasteners.

For example, in some aspects, the second valve disc member can be integrally formed with the first valve disc member.

For example, in some aspects, the pressure control valve can further include a first elastic member for biasing the first valve disc member in the second direction, and a second elastic member for biasing the second valve disc member in the first direction.

For example, in some aspects, the first valve disc member can include a body portion movable relative to the valve seat and configured to shield the valve hole, and the fluid passage can be formed by at least one through hole formed in the body portion.

For example, in some aspects, the pressure control valve can further include a retaining ring for retaining the first valve disc member and the second valve disc member in the valve seat.

For example, in some aspects, the first elastic member can be arranged between the first valve disc member and the retaining ring.

For example, in some aspects, the first valve disc member can further include an extending portion extending from the body portion in the second direction and a protruding portion protruding from the extending portion.

For example, in some aspects, a through hole for passage of the extending portion of the first valve disc member is formed on the second valve disc member.

For example, in some aspects, the second elastic member can be arranged between the second valve disc member and the protruding portion.

For example, in some aspects, the second elastic member can be arranged between the second valve disc member and the valve seat.

For example, in some aspects, the second valve disc member can be integrally formed with the first valve disc member. Further, the second valve disc member can include a base portion connected with the first valve disc member, an elastic neck portion extending from the base portion, and at least one tongue portion connected with the neck portion. The at least one tongue portion is configured to shield the at least one through hole of the first valve disc member.

For example, in some aspects, the neck portion can be used as the second elastic member.

For example, in some aspects, the first elastic member can be a helical spring, and the second elastic member can be an elastic support.

For example, in some aspects, the first predetermined value can be set by setting at least one of the elasticity of the first elastic member and the pressure receiving area of the first valve disc member, and the second predetermined value can be set by setting at least one of the elasticity of the second elastic member and the area of the fluid passage.

For example, in some aspects, the pressure receiving area of the first valve disc member can be defined by an overlapped area between the first valve disc member and the valve hole.

For example, in some aspects, the second predetermined value can be set to be greater than or equal to the first predetermined value.

For example, in some aspects, the second predetermined value can be set to be smaller than the first predetermined value.

For example, in some aspects, a part of the fixed scroll component around the communicating passage can be used as a valve seat of the pressure control valve, and the communicating passage can be used as a valve hole of the pressure control valve.

For example, in some aspects, the valve seat of the pressure control valve can be fitted in the communicating passage.

For example, in some aspects, the throttle valve may be a check valve allowing fluid to flow from the compression pocket to the backpressure cavity.

While various embodiments of the present disclosure have been described in detail herein, it should be understood that the present disclosure is not limited to the specific embodiments herein described and illustrated. Without departing from the spirit and scope of the disclosure, those skilled in the art can realize other modifications and variations. All such modifications and variations are within the scope of the present invention. Moreover, all the members, components or features described herein can be replaced by other members, components or features equivalent thereto in structure and function.

The invention claimed is:

1. A pressure control valve, comprising:

a valve seat, in which a valve hole is formed;

a first valve disc member movable relative to the valve seat and configured to shield the valve hole and in which a fluid passage is formed; and a second valve disc member movable relative to the valve seat and the first valve disc member, and the second valve disc member is arranged between the valve seat and the first valve disc member, the second valve disc member is configured to shield the fluid passage, wherein assuming that a direction directed from the second valve disc member to the first valve disc member is a first direction, when a pressure difference across the first valve disc member and the second valve disc member is directed to the first direction and is greater than or equal to a first predetermined value, the first valve disc member is opened so as to allow fluid to flow through the pressure control valve in the first direction; and when the pressure difference across the first valve disc member and the second valve disc member is directed to a second direction opposite to the first direction and is greater than or equal to a second predetermined value, the second valve disc member is opened so as to allow the fluid to flow through the pressure control valve in the second direction, wherein the first valve disc member comprises:

a first base portion fixed relative to the valve seat;

a first elastic neck portion extending from the first base portion; and a head portion connected with the first elastic neck portion, wherein the head portion is configured to shield the valve hole, and the fluid passage is formed by at least one through hole formed in the head portion.

2. The pressure control valve according to claim 1, wherein the second valve disc member comprises:

a second base portion fixed relative to the valve seat;

a second elastic neck portion extending from the second base portion; and a tongue portion connected with the second elastic neck portion, wherein the tongue portion is configured to shield the fluid passage of the first valve disc member and is movable in the second direction.

3. The pressure control valve according to claim 2, wherein an area of the tongue portion is smaller than that of the head portion of the first valve disc member.

4. The pressure control valve according to claim 3, wherein the second valve disc member further comprises a rim portion connected with the second elastic neck portion and surrounding the tongue portion, and the rim portion abuts against the valve seat around the valve hole, and the head portion of the first valve disc member is configured to shield the valve hole via the rim portion.

5. The pressure control valve according to claim 4, wherein the first predetermined value is set by setting at least one of elasticity and a pressure receiving area of the first valve disc member, and the second predetermined value is set by setting at least one of elasticity of the second valve disc member and an area of the fluid passage.

6. The pressure control valve according to claim 5, wherein the pressure receiving area of the first valve disc member is defined by an area between the rim portion of the second valve disc member and the tongue portion.

7. The pressure control valve according to claim 5, wherein the elasticity of the first valve disc member is mainly provided by the first elastic neck portion, and the elasticity of the second valve disc member is mainly provided by the second elastic neck portion.

8. The pressure control valve according to claim 1, wherein the second valve disc member is integrally formed with the first valve disc member.

9. A pressure control valve, comprising:

a valve seat, in which a valve hole is formed;

a first valve disc member movable relative to the valve seat and configured to shield the valve hole, and a fluid passage is formed in the first valve disc member;

a second valve disc member movable relative to the valve seat and the first valve disc member, and the second valve disc member is arranged between the valve seat and the first valve disc member, the second valve disc member is configured to shield the fluid passage; and a valve guard member, wherein assuming that a direction directed from the second valve disc member to the first valve disc member is a first direction, when a pressure difference across the first valve disc member and the second valve disc member is directed to the first direction and is greater than or equal to a first predetermined value, the first valve disc member is opened so as to allow fluid to flow through the pressure control valve in the first direction; and when the pressure difference across the first valve disc member and the second valve disc member is directed to a second direction opposite to the first direction and is greater than or equal to a second predetermined value, the second valve disc member is opened so as to allow the fluid to flow through the pressure control valve in the second direction, wherein the valve guard member limits displacement of the first valve disc member in the first direction.

10. The pressure control valve according to claim 9, wherein the valve guard member, the first valve disc member and the second valve disc member are fixed to the valve seat via a fastener.

11. A scroll compressor comprising:

a housing;

an orbiting scroll component disposed within the housing and comprising a first end plate and a first scroll vane formed on the first end plate;

a non-orbiting scroll component disposed within the housing and comprising a second end plate and a second scroll vane formed on the second end plate, wherein the second scroll vane is engaged with the first scroll vane in such a way that a series of compression pockets are formed between the first and second scroll vanes; and a pressure control valve disposed within the housing and comprising:

a valve seat, in which a valve hole is formed;

a first valve disc member movable relative to the valve seat and configured to shield the valve hole and in which a fluid passage is formed; and a second valve disc member movable relative to the valve seat and the first valve disc member, and the second valve disc member is arranged between the valve seat and the first valve disc member, the second valve disc member is configured to shield the fluid passage, wherein assuming that a direction directed from the second valve disc member to the first valve disc member is a first direction, when a pressure difference across the first valve disc member and the second valve disc member is directed to the first direction and is greater than or equal to a first predetermined value, the first valve disc member is opened so as to allow fluid to flow through the pressure control valve in the first direction; and when the pressure difference across the first valve disc member and the second valve disc member is directed to a second direction opposite to the first direction and is greater than or equal to a second predetermined value, the second valve disc member is opened so as to allow the fluid to flow through the pressure control valve in the second direction, wherein the first valve disc member comprises:

a first base portion fixed relative to the valve seat;

a first elastic neck portion extending from the first base portion; and a head portion connected with the first elastic neck portion, wherein the head portion is configured to shield the valve hole, and the fluid passage is formed by at least one through hole formed in the head portion.

12. The scroll compressor according to claim 11, wherein a recess is formed on a side of the second end plate opposite to a side of the second end plate on which the second scroll vane is formed; and wherein the scroll compressor further comprises a sealing assembly arranged in the recess, wherein a space between the recess and the sealing assembly forms a backpressure cavity, and the backpressure cavity is in fluid communication with one of the compression pockets via a communicating passage, wherein the pressure control valve is arranged in the communicating passage.

13. The scroll compressor according to claim 12, wherein a part of the non-orbiting scroll component around the communicating passage is configured to be the valve seat of the pressure control valve, and the communicating passage is configured to be the valve hole of the pressure control valve.

14. The scroll compressor according to claim 12, wherein the valve seat of the pressure control valve is fitted in the communicating passage.

* * * * *